US005214902A

United States Patent [19]

Jones

[11] Patent Number: 5,214,902

[45] Date of Patent: Jun. 1, 1993

[54] HAND-CARRYABLE SAFETY PACKAGE AND METHOD OF MAKING THE SAME

[75] Inventor: Paul T. Jones, La Grange Pk., Ill.

[73] Assignee: Safety Issue Corporation, La Grange Pk., Ill.

[21] Appl. No.: 751,513

[22] Filed: Aug. 29, 1991

[51] Int. Cl.[5] ..... B65B 35/56; B65B 61/14

[52] U.S. Cl. ..... 53/413; 53/134.1; 53/219; 53/446; 53/544

[58] Field of Search ..... 53/413, 134.1, 443, 53/444, 446, 219, 544; 493/226, 926; 229/87.04, DIG. 6, 914; 206/342, 338

[56] References Cited

U.S. PATENT DOCUMENTS

| | | | |
|---|---|---|---|
| 1,046,665 | 12/1912 | Smith | 206/342 |
| 2,468,695 | 4/1949 | Wallace et al. | 53/413 X |
| 3,057,472 | 10/1962 | Douty | 206/342 |
| 3,872,967 | 3/1975 | Brush | 229/87.04 X |
| 4,156,335 | 5/1979 | Strobl et al. | 53/444 |
| 4,269,247 | 5/1981 | Omdal | 493/926 X |

FOREIGN PATENT DOCUMENTS

| | | | |
|---|---|---|---|
| 2042469 | 9/1980 | United Kingdom | 493/926 |

*Primary Examiner*—James F. Coan

*Attorney, Agent, or Firm*—James Ray & Associates

[57] ABSTRACT

A hand-carryable package of metal railroad spikes and method of making the same, wherein the spikes are stacked in layers with the spikes in alternate layers at right angles to each other, providing an interlocking package contents, and a package container comprising a flexible material in a central portion of which the contents are placed and opposed edge portions of the container material are folded upwardly and inwardly to form container top and side walls, a terminal portion of a pair of opposed, inwardly folded edge portions being twisted and connected together to form a bail-like handle for lifting and carrying the package.

35 Claims, 9 Drawing Sheets

HAND-CARRYABLE SAFETY PACKAGE AND METHOD OF MAKING THE SAME

FIELD OF THE INVENTION

This invention relates to hand-carryable safety packages and, more particularly, to packages of steel railroad spikes and methods of making such packages.

BACKGROUND OF THE INVENTION

It has been conventional practice in the railroad industry to package spikes in rather large containers, such as kegs, holding for example about 240 to 250 spikes. Such containers weigh well over 200 pounds. As a consequence of lifting such heavy loads, back injuries have become prevalent among workers in this field. The cut spikes in particular are dangerous to handle because they have sharp chisel points. Past packaging and handling practice has been to load the bulk spikes into a metal keg of approximately 26 gauge thickness. Due to the random orientation of the spikes in the keg, the sharp chisel points penetrate the relatively thin gauge metal walls and protrude from the kegs as they are tipped over and transported during normal handling. The sharp spike points and the sharp burrs on the metal kegs caused by such spike penetration of the keg walls cause serious personnel injuries to the handlers.

In efforts to overcome such problem, attempts have been made to package spikes in smaller packages, for example of corrugated paperboard. Such attempts have not been successful, however. Such boxes become weakened when exposed to high moisture conditions and, due to the great weight of the contents, are easily ruptured. Also, due to the random orientation of the spikes, such packages are prone to penetration of the paperboard walls by the spikes thereby creating the potential for cut-type injuries and well as loss of contents. In addition, environmentally safe disposal of the large number of empty boxes is difficult. Although ultimately biodegradable, such degradation takes a long time; open air burning is not an acceptable alternative, and collection and recycling of widely dispersed boxes is time-consuming and costly.

SUMMARY OF THE INVENTION

The present invention provides a readily biodegradable container for railroad spikes which, in preferred sizes, is readily hand-carryable without danger of physical injury to the carrier. The invention provides an easily produced flexible container, preferably of an organic, woven fiber, such as a jute fabric, within which the spikes are layered in a substantially self-locking manner resistant to coming apart as well as maintaining the necessary geometry of the contents to prevent chisel point penetration of the package walls during rough handling in transportation of the package.

DETAILED DESCRIPTION OF THE INVENTION

Figure 1:
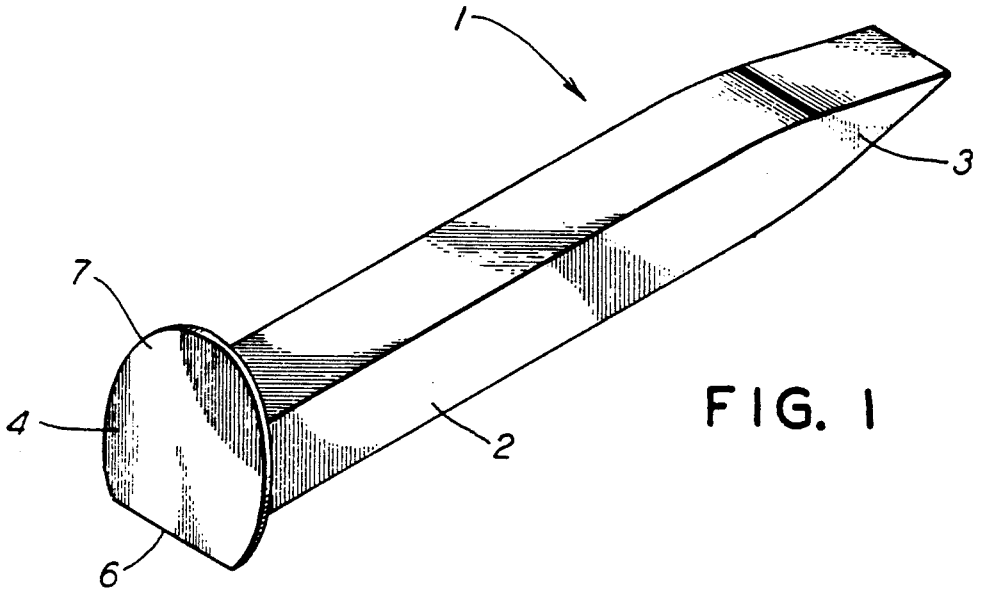
FIGS. 1 and 2 are two different isometric views of a metal railroad spike.
Figure 2:
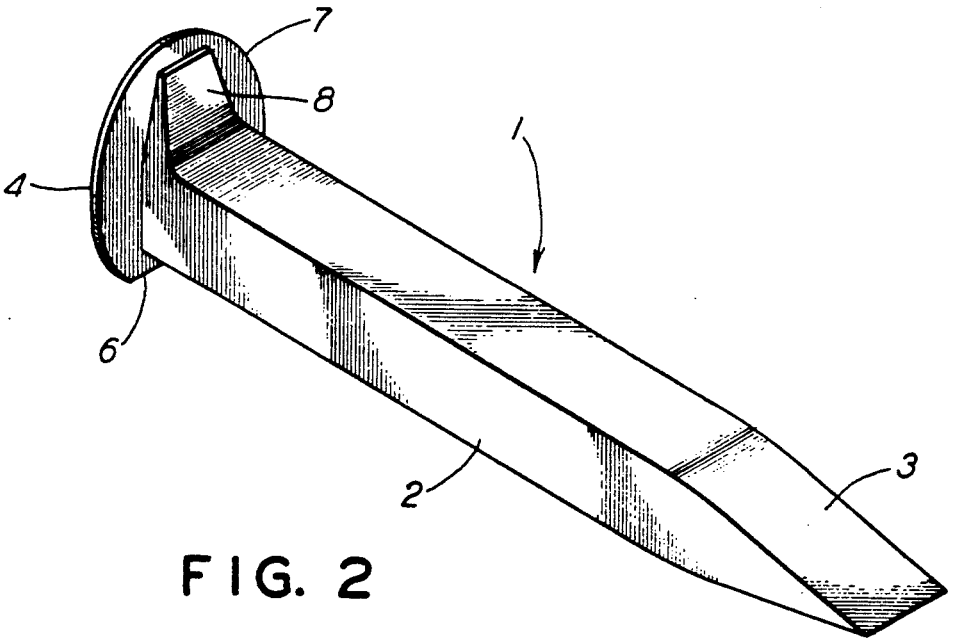

A standard railroad steel spike, denoted generally by the numeral 1 in FIG. 1, is about 6⅝ inches long and has a square cross-section shaft 2 with a pointed, wedge-shaped end 3 for driving into a wooden railroad tie. The spike has a head 4 with an upper, convexly shaped striking surface of generally elliptical shape truncated at one the smaller ends of the ellipse thereby forming a head end in the form of a straight line. This end of the head 4 projects a short distance, about 3/16 inch, from one side of the shaft 2, forming a lip 6. The other end of the head 4 extends outwardly of an opposite side of the shaft 2 for a greater distance than the projecting lip 6, i.e. for about ¾ inch, thereby forming a nose 7. The head has an under surface which, in a portion underneath the nose 7, is provided with a reinforcing rib 8, of generally truncated triangular or pyramidal form, extending from the juncture of the nose 7 with the corresponding surface of the shaft 2 to a position adjacent but slightly spaced (about 150 inch) from an extreme outward tip of the nose 7.

Figure 3:
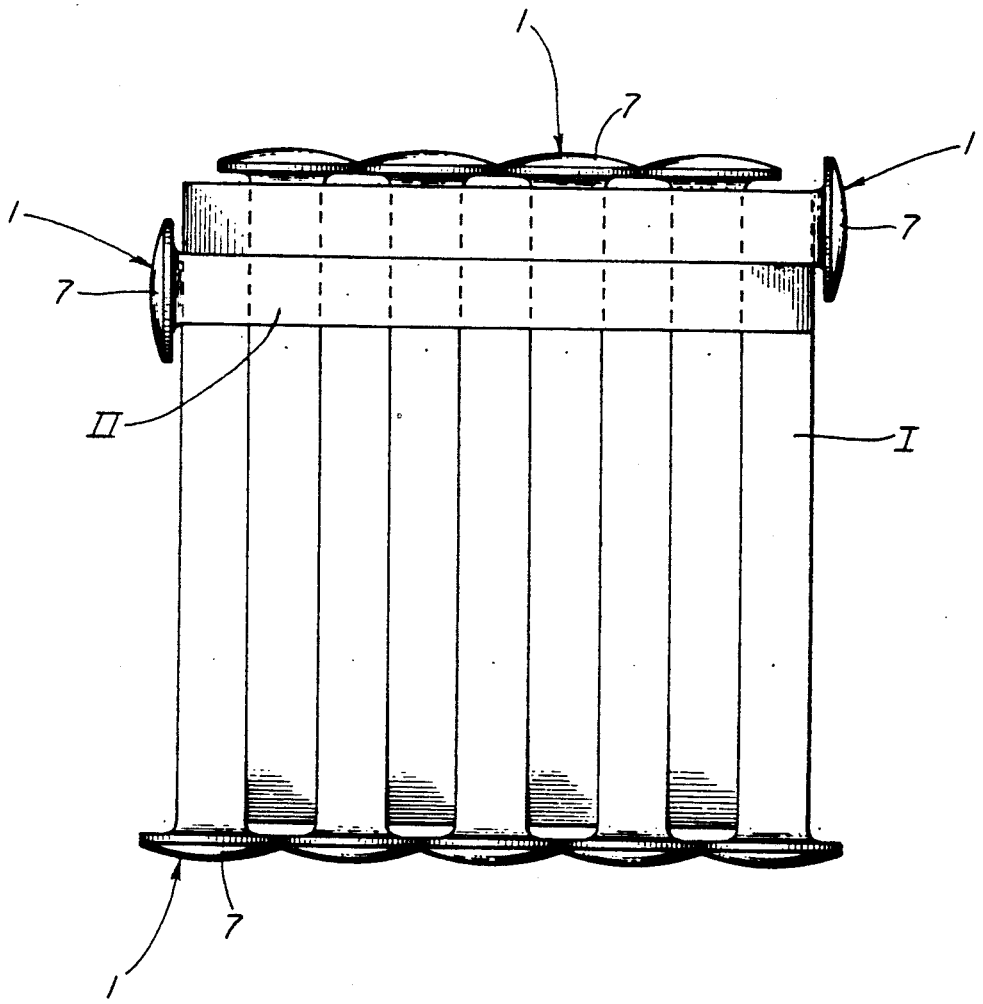
FIG. 3 is a top plan view of an assemblage of railroad spikes comprising two layers of spikes laid at right angles to each other.

FIG. 3 illustrates a generally arrangement of a plurality of juxtaposed spikes 1 at right angles to each other in each of two layers, I and II. Nine juxtaposed spikes are shown in each layer, with the projecting nose 7 of each spike 1 in an upward position, thereby providing layers each of which has a width about the same as the length of a spike, that is, approximately 6⅝ inches.

Figure 4:
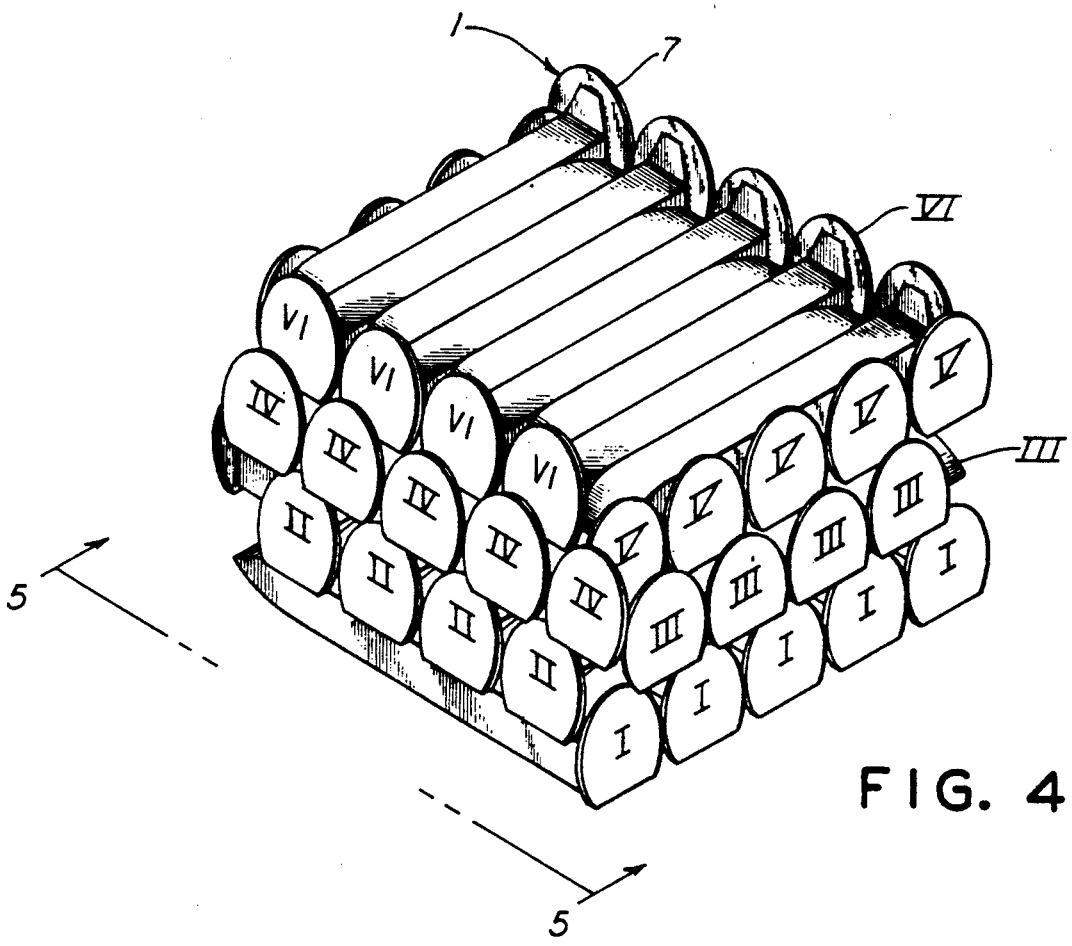
FIG. 4 is an isometric view of a stack of 6 layers of railroad spikes wherein the layers of spikes are arranged with heads of the spikes in alternate layers positioned on opposite sides of spike heads in adjacent layers and wherein, in the direction 10—10, the upwardly projecting head portion of the spikes in the lowermost layer are positioned inside the heads of the next upper layer, thereby providing a stack of spikes having a generally square cross section in a horizontal plane.
Figure 5:
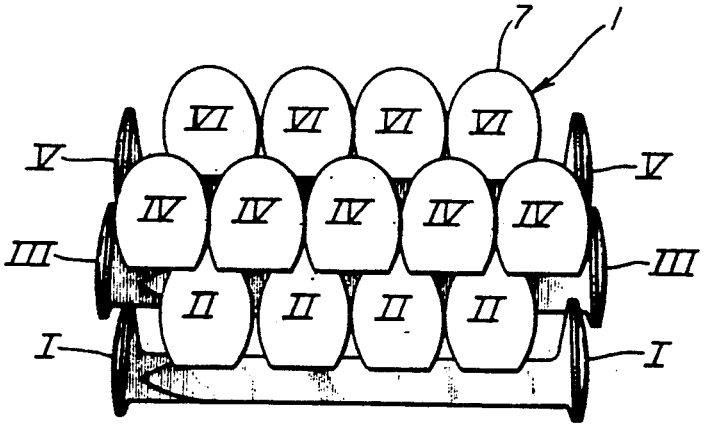
FIG. 5 is a side elevational view, in the direction 5—5 as shown in FIG. 4, of the stack of spikes shown in FIG. 4.

In FIGS. 4 and 5, there is provided a stacking arrangement of spikes 1 in which six layers of nine juxtaposed spikes, i.e. layers I–VI, as illustrated in FIG. 3, are placed one on top of the other with the noses 7 of spike heads 4 in successively upward layers being alternately arranged outside and inside the lips 6 of spike heads 4 in adjacent layers thereby forming side walls of a spike stack having, in the horizontal plane, a cross-section of generally square shape. Thus, in the view shown in FIG. 5, the upwardly positioned noses 7 of the lowermost row of spike heads, in layer II, is inside the lips 6 of the spike heads in the next higher row of spikes in layer IV; the heads in layer IV are inside the heads of the spikes in the next layer, IV, of spikes, and the noses 7 of layer IV are outside the lips 6 of layer VI.

Figure 6:
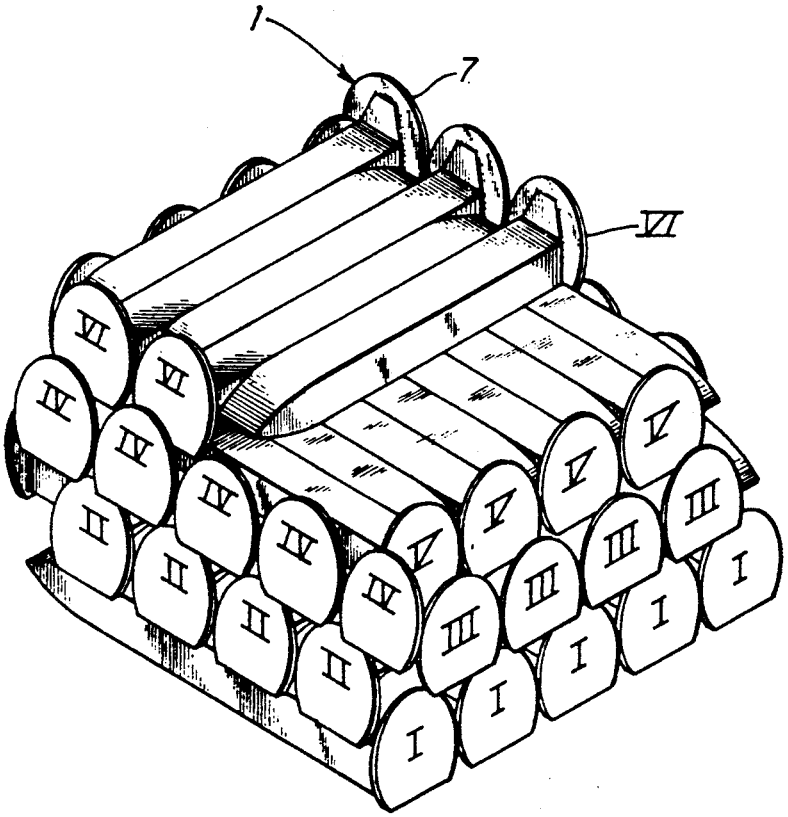
FIG. 6 is an isometric view, similar to the view of FIG. 4, in which the layers of spikes are arranged as shown in FIGS. 4 and 5, but with some of the spikes in the uppermost layer being removed.

The same staking arrangement as shown in FIGS. 4 and 5 is also shown in FIG. 6, with part of the uppermost layer VI of spikes 1 removed, better to illustrate the juxtaposed, layered spike.

Figure 7:
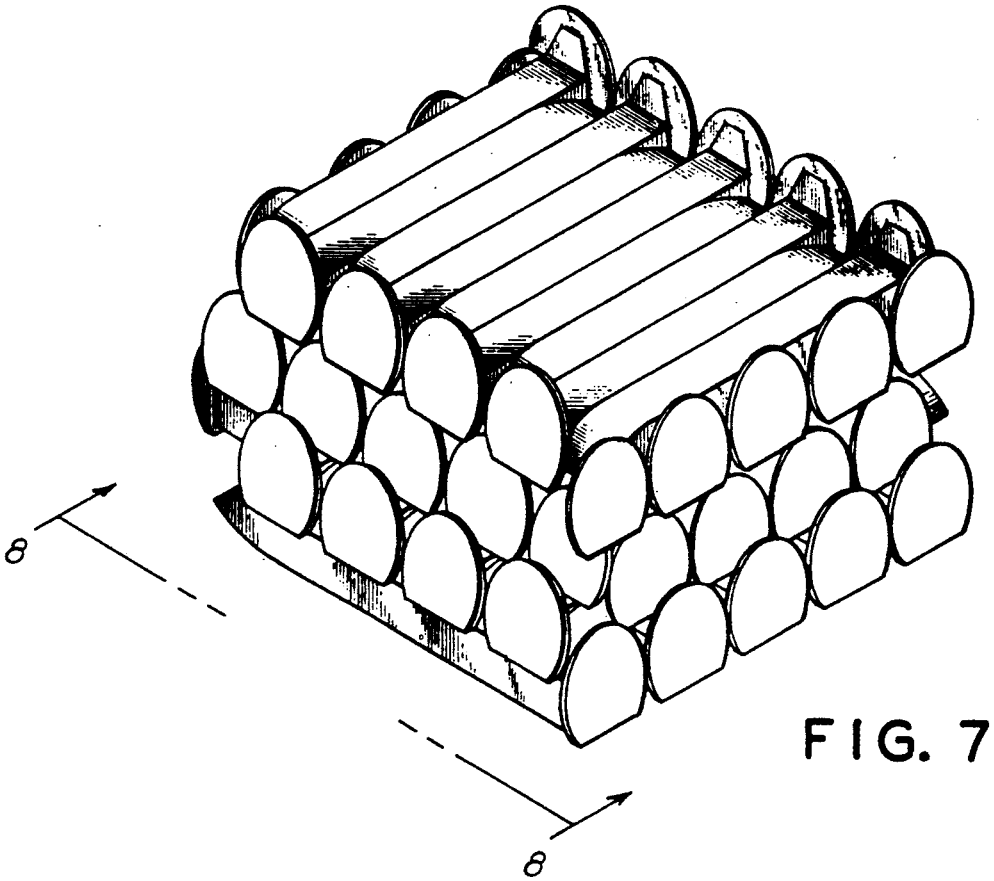
FIG. 7 is an isometric view of the stack of spikes shown in FIG. 4, shown from a opposite direction, i.e. in the direction 8—8 as shown in FIG. 4.
Figure 8:
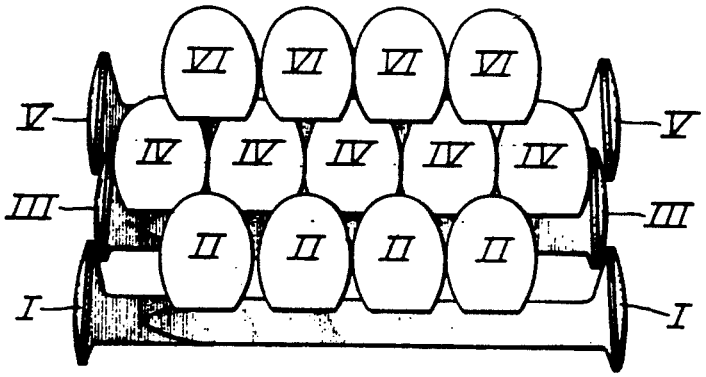
FIG. 8 is a side elevational view of the stack of spikes shown in FIGS. 4 and 7, in the direction of 8—8 as shown in those figures.

In FIGS. 7 and 8, the same stacking arrangement of spikes 1 as in FIGS. 4 and 5 is shown from a different direction, i.e. direction 8—8 in FIG. 7.

Accordingly the stacks shown in FIGS. 4–8 have a square cross-section in a horizontal plane.

Such stacking arrangement is preferred, because this compact stacking of fifty-four spikes provides a package contents weighing about forty-four pounds—which is a conveniently sized and easily liftable package which normally will not result in excessive back injuries as result from lifting the large, e.g. 200 pound, kegs of spikes as used by the railroad industry prior to introduction of the new package provided by the present invention.

Figure 9:
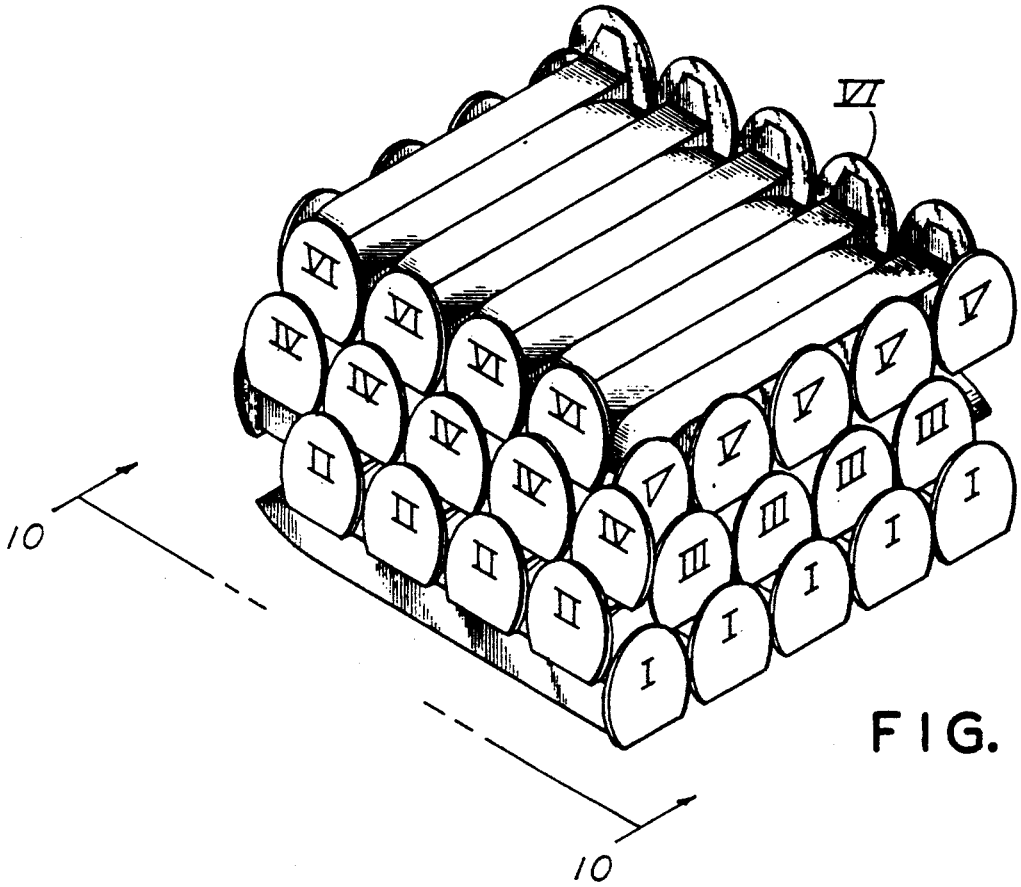
FIG. 9 is an isometric view of another type of spike stacking arrangement in which the layers of spikes are arranged with heads of the spikes in each successively higher layer arranged inside adjacent spike heads with the spikes in layer below the topmost layer being spaced apart a sufficient distance to accommodate such stacking arrangement, thereby providing a stack of generally truncated pyramidal shape.
Figure 10:
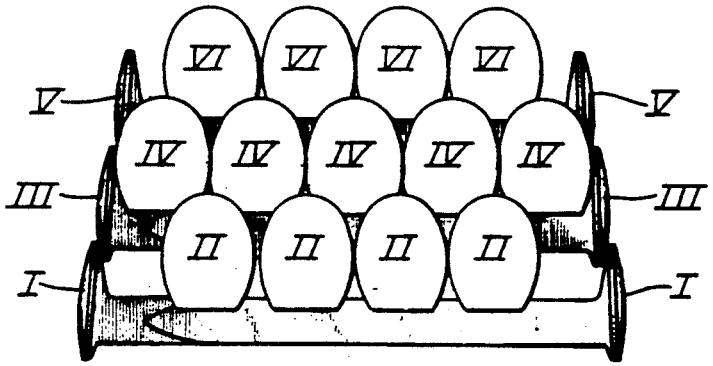
FIG. 10 is an end elevational view, of the stacking arrangement shown in FIG. 9, in the direction of 10—10 of FIG. 9.

The stacking arrangement of spikes 1 as shown in FIGS. 9 and 10 is different from that shown in FIGS. 4–8 in that, in the FIGS. 9 and 10 arrangement, the lip portions 6 of each successively higher row of spike heads 4 are inside the nose portions 7 of the next lower row of spike heads, thereby forming a stack having a generally truncated pyramidal shape. In order to stack the spikes in such arrangement, it is necessary to space apart the spikes in each lower layer a sufficient distance to provide an uppermost layer, VI, as shown in FIGS. 9 and 10, wherein the spikes are juxtaposed to provide a layer width and length equal to the individual spike length. For example, in a stacking arrangement of six layers of nine spikes per layer as shown in FIGS. a bottom layer, I, length and width of about 8⅝ inches is required to provide a top layer, VI, having length and width dimensions of 6⅝ (6.625) inches. Such dimensions of layer I will accommodate three additional spikes of ⅝ (0.625) inch shaft cross-section in a plane normal to the length of the spike $(8.625-6.625)/0.625=3.2$. Successively higher layers will have smaller length and width dimensions up to the limiting 6⅝ dimension of the topmost layer. If insertion of additional spikes in the layers below the topmost layer is not desired, e.g. in order to limit the weight of the package, the spikes in the layers below the topmost layer can merely be spaced apart. In such case, the package nevertheless will have sufficient structural integrity to withstand forces applied during transport and handling, because the pressure exerted on the heads 4 of the spikes 1 comprising the side walls of the stack of spikes by the flexible material in which the spikes are packaged, on lifting the package, normally will be sufficient to force together the spikes in the layers below the topmost layer, thereby effectively locking the spikes together.

Still other stacking arrangements may be used if desired. For example, in the illustrated six-layer arrangement, the bottom three layers may be of the truncated pyramidal form of FIGS. 9 and 10, and the top three layers may be of inverted truncated pyramidal form.

Packages within the contemplated scope of the invention may comprise larger numbers of layers and larger numbers of spikes per layer.

Figure 11:
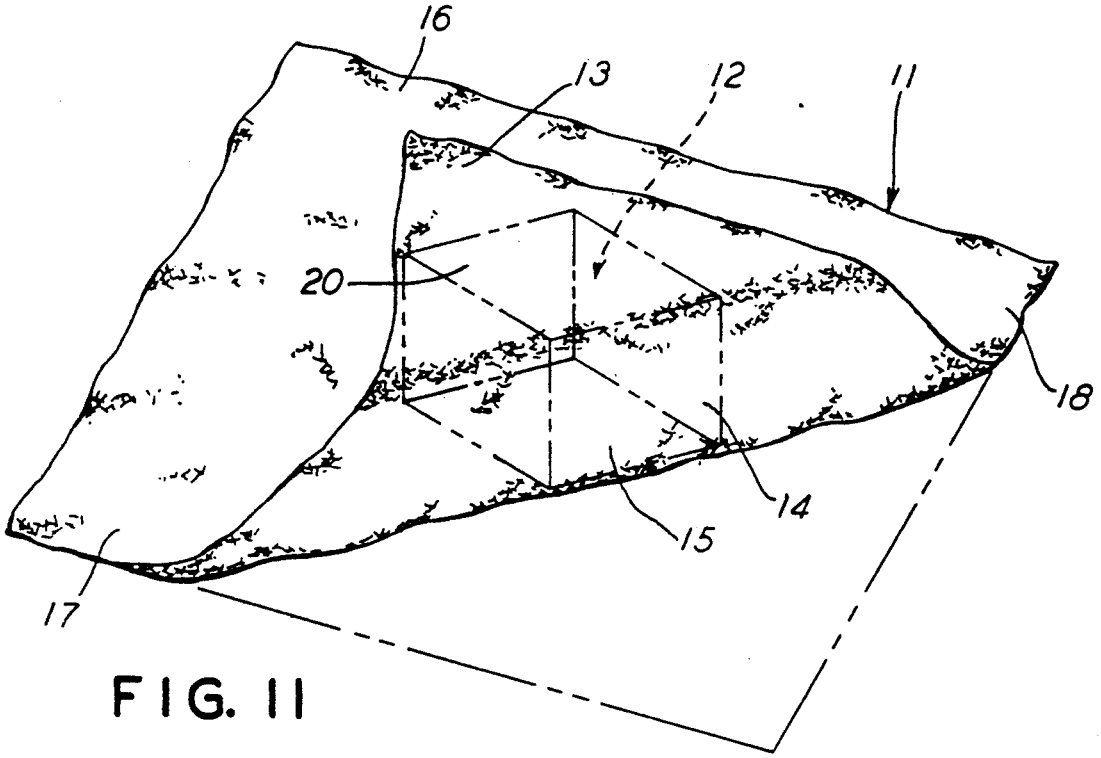
FIG. 11 is an isometric view of a schematically indicated stack of spikes placed in the center of a container parison constituting a rectangular piece of flexible material, with one corner of the parison material folded over the top of the stack of spikes.

In further reference to the flexible packaging material, FIG. 11 shows a stack of spikes, generally denoted by the numeral 12 and indicated in dashed lines as a rectangular structure, placed in a central portion of a container parison denoted generally by the numeral 11 and comprising a generally rectangular, preferably square, piece of flexible material, preferably a biodegradable material, such as a woven natural fiber, especially a jute fabric. Such central portion of parison 11 thereby forms a container bottom 15. As shown in FIG. 11, a first corner portion 13 is folded upwardly and inwardly of the package contents 12, thereby forming a first container side wall 14 and a first container top element 20.

Figure 12:
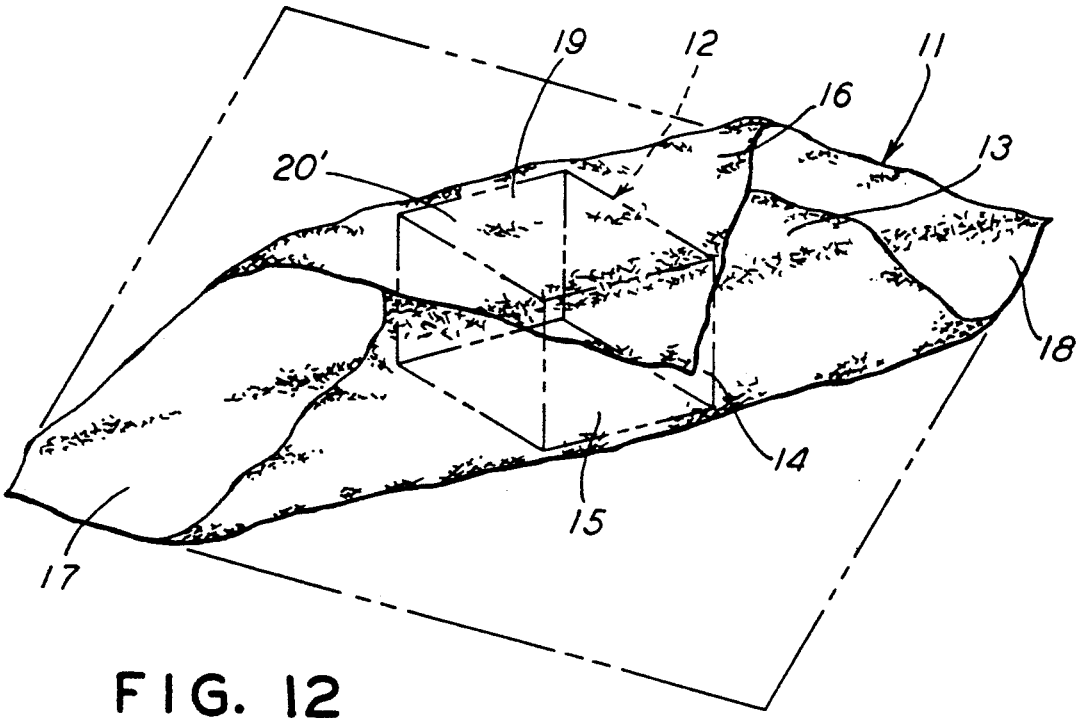
FIG. 12 is a view similar to FIG. 11, wherein a second corner of the parison material is folded over the top of the stack of spikes.

In FIG. 12, a second corner portion 16 of the container parison 11 similarly is folded upwardly and inwardly to form a second container side wall 19 and a second container top element 20' overlying the first container top element 20. At this stage of formation of the package container, third and fourth corner portions 17 and 18 remain in the original flat condition of the parison 11.

Figure 13:
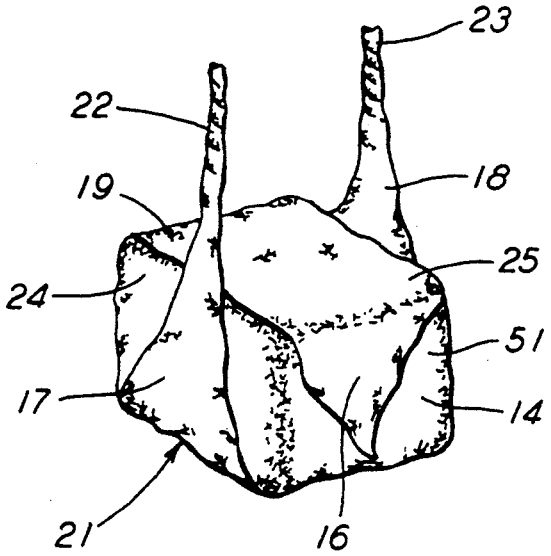
FIG. 13 is an isometric view of a partially completed package of the invention, wherein all four corners of the parison material are folded over the top of the package contents and end portions of two opposed corners of the parison material are twisted into handle portions.

FIG. 13 shows the third and fourth corner portions 17 and 18 folded upwardly and inwardly of the package contents to form third and fourth container side walls 24 and 25. End portions of the third and fourth corner portions 17 and 18 are twisted about themselves to form generally cylindrical handle portions 22 and 23 respectively.

Figure 14:
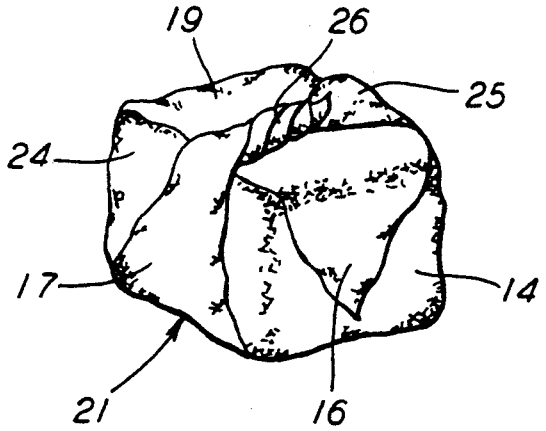
FIG. 14 is an isometric view of the completed package in accordance with the invention, with the twisted handle portion detachably connected together to form a bail-like handle for hand carrying the package.

In FIG. 14, the handle portions 22 and 23 are secured together to form a bail-like handle for lifting and carrying the thus-formed package. Preferably, the handle portions are detachably secured together either by sewing, adhesively or, especially by means of a metal or plastic tie, either of twistable type or one with cooperating slot and teeth of know construction.

The material chosen for the container parison 11 may be any material having sufficient flexibility to accommodate the folding and twisting actions incident to forming the package container and sufficient to hold the considerable weight of the spike contents. Biodegradable organic materials are highly preferred for their ease of disposal without environmental pollution. A jute fabric having an appropriate weight and strength, for example similar to the familiar "gunny sack," is especially useful for this purpose. Other materials, such as various plastics, in either sheet or woven form may be used as well as other woven materials of natural, organic origin.

When porous materials such as jute or other woven natural fibers are used for the container parison 11, it is desirable that the bottom 15 of the container and at least a lower portion, for example about ½ inch to about 1 inch of the side walls 14, 19, 24 and 25 be treated with a water-proofing material. It also is desirable that the corner portions folded inwardly and forming the overlying elements of the container top be detachable secured together and, preferably, also detachable secured, for example adhesively, to a top and/or supper side portions of the package contents. It is further desirable that the twisted portions 22 and 23 forming the handle 26 be treated with a material having sufficient adhesive property to retain those twisted portions of the container material in such twisted condition. A paraffin wax which is a solid at relatively high ambient temperatures, for example, up to over 100° F. and which, upon mild heating, liquifies and can be brushed or sprayed onto such areas of the container, or onto the entire container if desired, is especially useful for its waterproofing and adhesive properties. Alternatively, other adhesives, preferably of a waterproofing nature can be used and a material, such a copper sulfate may be used to additionally confer resistance to rotting type degradation of the container material.

Container parison configurations other than the illustrated square shape may be used, for example a circular parison. In such case, diametrically opposed potions of the circular parison are folded upwardly and inwardly to form the container side and top walls, with at least one pair of such inwardly folder portions being twisted to form handle portions which are connected to form a carrying handle. Similarly, any polygon, especially those having an even number of sides, may be used as a container parison, and diagonally opposed corner portions upwardly and inwardly folded as above-described to form the container and a carrying handle.

stacking railroad spikes as above-described provides an interlocking of the spikes such that, in cooperation with the flexible side walls of the container, a package is provided with excellent resistance to breaking apart during transport and handling. Even in the described embodiments wherein the spikes in each layer are not directly juxtaposed to each other but have some spacing between them are so resistant to disintegration of the stacking structure. In such cases, a minimum spacing and consequent interlocking of spikes results from the pressure on the spike heads comprising the contents side walls by the flexible container side walls during lifting of the package. In any case, when the package has been formed, and before the handle portions are joined together, it is advisable to tighten the package by drawing the flexible container material tightly about the package contents. This assures that any inter-spike spacing is reduced to a minimum, providing maximum inter-locking of spikes and elimination of excessive movement of the container material during transport and handling. Such tightening of the container can be done by hand or by application of a pulling and twisting motion by any suitable mechanical device. Similarly, the spikes can be stacked by hand, or by means of suitable mechanical stacking mean.

Figure 15:
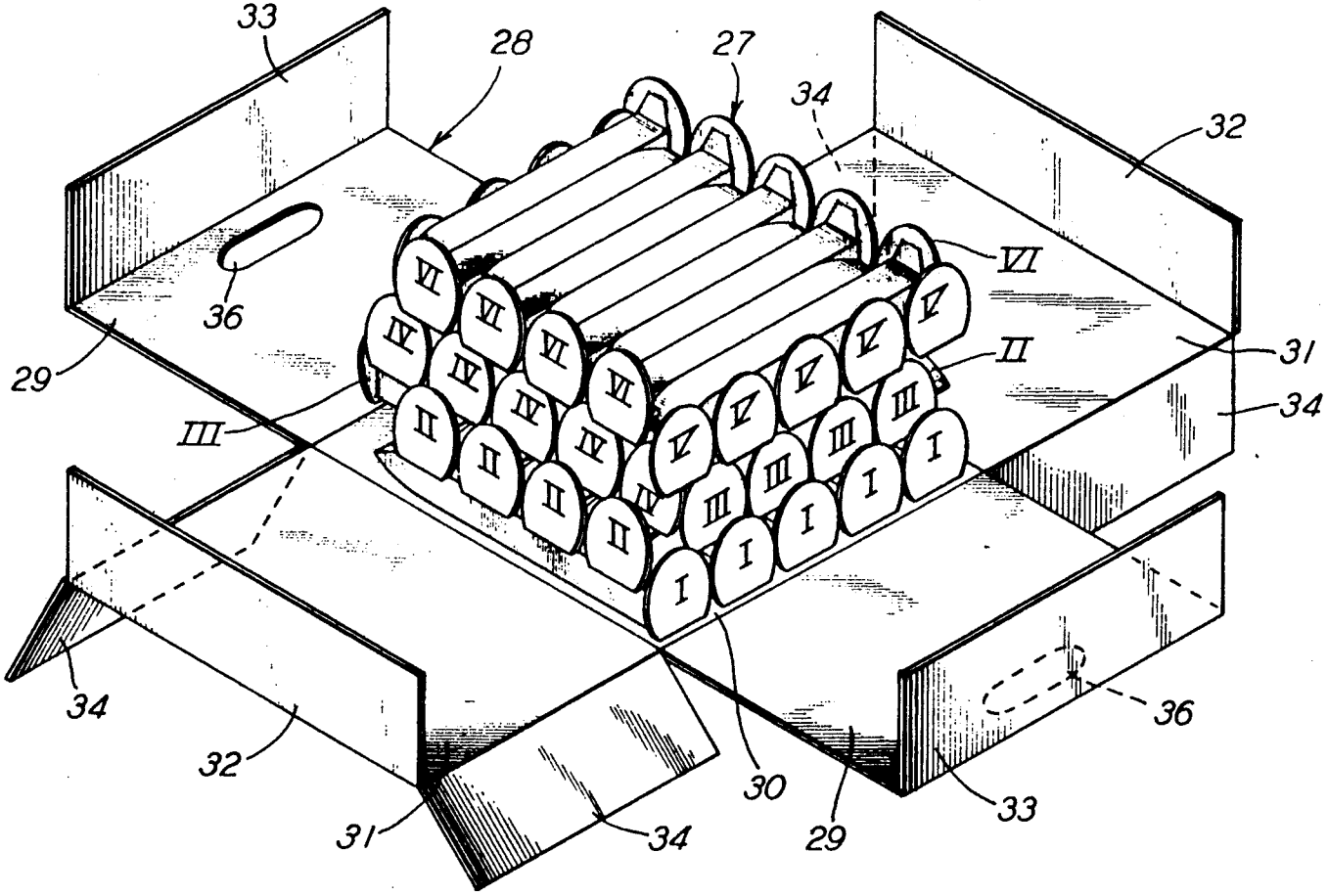
FIG. 15 is an isometric view of an alternative package, wherein the package comprises a number of spikes, stacked in accordance with the invention and a container of fiberboard material.

In FIG. 15 there is illustrated an alternative embodiment of the invention in which a number of railroad spikes, denoted generally by the numeral 27, are stacked as above described and the container comprises a parison formed of a fiberboard such as corrugated paperboard and denoted generally by the numeral 28. Container 28 comprises a bottom wall 30 on which the spike stack 27 is placed, a pair of end walls 29 and front and back walls 31. Each of the end walls 29 is provided with a top sealing flap 32 and the front and back walls 31 are provided with top sealing flaps 33. In an assembled condition of the container 28 the top flaps overlay the top of the stack 27 forming a container top wall. The front and end walls 31 are provided with pairs of side sealing flaps 34 each of which is suitable secured to an adjacent end wall, e.g. by means of staples or an adhesive.

The container 28 may be provided with perforations 36 in a pair of side walls, e.g. the end walls 29 for punching out to form hand holds for lifting the package. Other suitable handle means can be provided as known to those skilled in the art. If desired, the areas of the end walls 29 surrounding the perforations 36 maybe reinforced, for example, with one or more additional layers of paperboard.

It will be understood that the fiberboard container as used in the package of the invention is not limited to the particular design shown in FIG. 15, but that other suitable container designs may be used for packaging a plurality of layers of spikes, or a number of stacks of spikes. The fiberboard used preferable is a heavy gauge, multiple-ply corrugated paperboard sufficient to withstand the weight of the spike contents, and preferably also is of a moisture resistant nature.

Packages utilizing a formed parison of fiberboard or other relatively non-flexible material have the advantage over prior art packages using similar container materials in that the orientation and locked-together configuration of the stacked spikes prevents penetration of the container walls by the chisel-like points of the spikes with the accompanying disadvantages as above described.

What is claimed is:

1. A method for hand-carrying railroad spikes of the type having a generally square shaft tapered to a wedge-shape at one end thereof and having on the other end an elongated head in the form of a truncated ellipse projecting from a first side of the shaft in the form of a nose having a length about one-half the longer dimension of the truncated ellipse, the head also extending outwardly from a second, opposite side of the shaft in the form of a lip having a length substantially less than the length of the nose, the head having an upper, striking surface and a lower surface provided with a strengthening rib of generally truncated pyramidal shape extending from a junction of the head with the first side of the shaft, outwardly thereof, underneath the nose, and decreasing in thickness outwardly of the spike shaft to a rib terminus adjacent an outermost extremity of the nose, which method comprises:

a. forming a number of layer of spikes with the projecting noses of the spike heads facing upwardly, away from the bottom of the container;

b. in each layer, juxtaposing to each other the heads of alternate spikes, whereby at least a portion of the wedge-shaped ends of the spikes are juxtaposed to the lower surfaces of alternate spikes in that layer;

c. juxtaposing the shaft of an outermost spike in each alternate layer to the strengthening ribs of alternate spikes forming a side wall of an adjacent layer;

d. in each layer above the lowermost layer of spikes, juxtaposing the lips of the spike heads against an upper and outer corner of the two outermost spikes in the next lower layer, and e. packaging the thus-formed layers of spikes, whereby locking together of the layered spikes is facilitated and integrity of the package is maintained during transport and handling.

2. A method according to claim 1, further comprising packaging the layers of spikes in a container of flexible material having a bail-like handle, whereby, on lifting the package, the weight of the contents on the package, draws the flexible container snugly about the contents thereby further facilitating locking together of the layered spikes and maintenance oft he package integrity during handling.

3. A method according to claim 2, wherein the cross-section of the shaft of each spike, in a plane normal to the shaft length, is about $\frac{5}{8}$ inch$\times\frac{5}{8}$ inch, the length of the shaft, from the tip of the wedge-shaped end to the juncture of the strengthening shoulder, is about 5 inches, the length of the outwardly extending second end of the spike head is about $\frac{1}{8}$ inch, the length of the projecting portion of the first end of the spike head is about $\frac{3}{4}$ inch, and the overall length of the spike is about $6\frac{5}{8}$ inches, and the method comprises arranging the spikes in six layers of nine spikes each, thereby forming an easily hand-carryable substantially square package contents weighing about 44 pounds.

4. A method of making a hand-carryable container, comprising:

a. providing a parison consisting of a container blank of flat, flexible material, b. upwardly folding at least two pairs of opposed edge portions of the blank for a distance greater than that required for forming container side walls of a height sufficient to accommodate a solid article or articles contents to be packaged, c. then inwardly folding an upper part of each upwardly-folded blank portion to an extent that a leading edge of each inwardly-folded portion of the blank reaches a point substantially coincident with the point of the contents most remote from such leading edge in unfolded condition of the blank, thereby forming container side walls and a container top wall, d. twisting each of at least one pair of opposed inwardly folded portions of the blank into a generally cylindrical form, and e. detachably securing together such twisted portions to form a handle for hand carrying the container.

5. A method according to claim 4, comprising selecting a container blank having a shape selected from the group consisting of a circle and a polygon having an even number of sides, whereby, after inwardly folding the upper pards of upwardly-folded opposed pairs of edge portions of the blank, the container has a number of side walls equal to the number of sides of the selected blank shape.

6. A method according to claim 5, comprising selecting a container blank of generally rectangular shape, folding first parts of each the four corner portions of said blank upwardly along a first fold line constituting a junction between a container bottom and one of four corresponding container side walls formed by the upwardly folded and upwardly extending portions of the blank, further folding second parts of each of such four corner portions of the blank inwardly of the thus-formed container side walls and in mutually overlapping manner thereby forming a container top wall, and twisting two diagonally opposed corners of the inwardly-folded second portions of the blank into generally cylindrical handle portions, and detachable securing free extremities of the handle portions together to form a bail-like package carrying handle.

7. A method according to claim 6, further comprising detachable securing together the overlapped inwardly-folded portions of the blank, and applying to the twisted handle portions a material effective to retain such handle portions in such twisted shape.

8. A method according to claim 7, comprising securing together the overlapped portions of the blank and retaining the twisted blank portions in twisted shape by applying thereto a liquid material having adhesive and water-proofing properties.

9. A method according to claim 8, further comprising detachably securing the handle portions together by applying thereto an adhesive material.

10. A method according to claim 8, wherein the blank is a woven, biodegradable fabric, the liquid material is a paraffin wax, and the handle portions are mechanically secured together with a detachable twistable tie.

11. A method of packaging articles in a hand-carryable container comprising:

a. providing a container parison consisting of a flexible sheet material having the shape of a circle or a polygon with an even number of sides;

b. arranging, in a generally central portion of the sheet, at least one layer of articles to be packaged, thereby providing a package contents having a bottom, top and side wall surfaces defined by exposed surfaces of the articles;

c. folding opposed edge portions of the sheet first upwardly of the sheet and then inwardly toward the package contents to form package side and top walls;

d. twisting portions of a pair of inwardly-folded diagonally opposite edge portions of the sheet into a form of handle portions, and e. detachably securing together the handle portions to provide a bail-like handle for carrying the package.

12. A method according to claim 11, further comprising selecting a container parison sheet of substantially rectangular form, whereby the diagonally opposed edge portions are the four corner portions of the sheet.

13. A method according to claim 12 further comprising disposing in each layer a plurality of articles, each of which has an elongated body portion and a pair of end portions, in horizontal and substantially parallelly aligned positions in a generally central portion of the sheet, thereby providing a package contents having a top and a bottom thereof formed by the elongated body portions of the articles and side walls formed by the end portions of the articles.

14. A method according to claim 13, further comprising selecting a container parison sheet of substantially square form, and disposing each contents side wall substantially in a plane at an angle of about 45 degrees to vertical planes through the sides of the unfolded parison sheet, whereby, upon folding of the parison sheet, the sheet is positioned snugly against the respective package contents side walls.

15. A method according to claim 14, further comprising:

a. placing together a first number of elongated articles of substantially equal lengths and substantially uniform cross-section in a plane perpendicular and at a right angle to a longitudinal centerline of the article, with a thickness dimension of the articles lying in vertical planes normal to the sheet in unfolded condition, thereby forming a first layer of articles;

b. arranging the remainder of the articles in an additional integral number of layers wherein such integral number has a value of at least one and is not substantially greater than a number which, when multiplied by the thickness dimension of an article, is equal to the minimum distance from a side wall of the package contents to a corresponding corner of said sheet in unfolded condition of said sheet plus a distance from such one package contents side wall to an opposite package contents side wall, and c. arranging the articles in each layer in mutually parallel positions in each of said layers and at substantially right angles to the articles in adjacent layers, thereby forming a package contents having side walls composed of article ends.

16. A method according to claim 15, further comprising placing the articles in each layer in mutually substantially juxtaposed position whereby the package contents have width and length dimensions substantially equal to the article length, and the integral number has a value of at least one and is not substantially greater than a number which, when multiplied by a thickness dimension of an article, is equal to the length of an article plus the minimum distance from a side wall of the package contents to a corresponding corner of said sheet in unfolded condition of said sheet.

17. A method according to claim 16, wherein the sheet material is a biodegradable material.

18. A method according to claim 17, wherein the sheet material is a woven fabric.

19. A method according to claim 18, wherein the sheet material is a woven jute fabric.

20. A method according to claim 16, wherein the articles are metal railroad spikes.

21. A method according to claim 20, wherein the sheet material is a woven jute fabric.

22. A method according to claim 20, wherein the spikes comprise a substantially square cross-section shaft, a wedge-shaped end for driving the spike into a wooden railroad tie and a head substantially in the form of a truncated ellipse having the smaller ends thereof in the form of a straight line one of which is adjacent one side of the spike shaft and the balance of the truncated ellipse overlies and projects beyond an opposite side of the corresponding square end of the spike shaft.

23. A method according to claim 22, further comprising arranging the spikes such that the head ends of the spikes in each layer are juxtaposed to wedge-shaped ends in adjacent layers and the head ends of the spikes in alternate layers form a side wall of the package contents.

24. A method according to claim 23, further comprising arranging the spikes such that the projecting portions of the truncated elliptical head ends of each of the spikes are oriented int eh same direction.

25. A method according to claim 24, further comprising off-setting the head ends of the spikes in alternate layers of each package contents side wall, in a direction along the length of the spike, from the head ends of the spikes in the nearest alternate layers in the same side wall whereby, when the package is lifted, the sheet material exerts pressure on the head ends of the spikes forming each contents side wall thereby locking the layers together and providing a package resistant to disengagement of the spikes during transport and handling of the package.

26. A method according to claim 25, further comprising detachably securing at least a portion of the untwisted inwardly-folded corners of the sheet material tot he contents of the package.

27. A method according to claim 26, further comprising selecting the sheet material from the group consisting of woven, biodegradable fabrics, and applying a treating material having adhesive and water-proofing properties to the inwardly-folded corner portions of the sheet material to secure such untwisted portion of the sheet material together and to the package contents and to retain such twisted portions of the sheet material in such twisted condition.

28. A method according to claim 27, further comprising applying a detachable twisted tie tot eh twisted portions of the sheet material thereby providing a package carrying handle.

29. A method according to claim 28, further comprising impregnating the sheet material forming the package bottom and at least a portion of the sheet material forming the package side walls adjacent the package bottom with such liquid material.

30. A method according to claim 29, wherein the liquid material is a paraffin wax.

31. A method for making a hand-carryable package for transporting and handling railroad spikes, comprising:

a. stacking the spikes in a plurality of layers;

b. arranging the spikes in alternate layers in opposite directions with spike heads forming side walls of the stacked layers, and c. enclosing the stacked spikes in a hand-carryable container.

32. A method according to claim 31, further comprising:

a enclosing the stacked layer of spikes within a hand-carryable container having flexible side walls, and b. tightening the flexible container side walls against the heads of the spikes forming side walls of the stacked layers, thereby further locking the spikes together.

33. A method according to claim 32, further comprising:

a. providing a container parison consisting of a generally rectangular flexible sheet material;

b. placing on the sheet a package contents having a bottom, a top, and side walls, said contents being disposed with the bottom thereof in a generally central portion of the parison sheet, whereby a container bottom comprises such generally central portion of said sheet underlying the bottom of the package contents, c. folding a plurality of pairs of diagonally opposed edge portion of the sheet inwardly toward the package contents in a direction of a center of the sheet, thereby forming a container top wall and container side walls in number from one in the case of a circular sheet to a number equal to the number of sides of the polygon in case of a polygonal sheet, d. twisting on itself into a generally cylindrical form at least one pair of such diagonally opposed and inwardly folded edge portions thereby forming container handle portions;

e. detachably securing together such twisted handle portions thereby forming a bail-like handle for hand carrying the container, and wherein the dimensions of the parison sheet are such that, upon such inward folding of such diagonally opposed edge portions of the sheet, at least one pair of such inwardly-folded edge portions overlies the top wall of the package contents, and the supposed and twisted handle portions overlap each other a distance at least sufficient to accommodate said handle securing means.

34. A method according to claim 31, wherein the container is formed of rigid material.

35. A method according to claim 34, wherein the rigid material is a corrugated paperboard.

* * * * *

UNITED STATES PATENT AND TRADEMARK OFFICE

CERTIFICATE OF CORRECTION

PATENT NO. : 5,214,902

DATED : June 1, 1993

INVENTOR(S) : PAUL T. JONES

It is certified that error appears in the above-identified patent and that said Letters Patent is hereby corrected as shown below:

Column 2, line 16, delete "of"
column 2, line 28, delete "of", first occurance
column 3, line 4, delete "150" and insert --1/8--
column 3, line 28, delete "staking" and insert
--stacking--
column 4, line 57, delete "know" and insert
--known--
column 5, line 12, delete "supper" and insert
--upper--
column 5, line 40, delete "stacking" and insert
--Stacking--
column 7, line 13, delete "oft he" and insert
-- of the--
column 7, line 54, delete "pards" and insert --parts--
column 8, line 3, delete "detachable" and insert
--detachably--
column 8, line 7, delete "detachable" and insert
--detachably--
column 9, line 60, delete "int eh" and insert
--in the--
column 10, line 7, delete "tot he" and insert
--to the--
column 10, line 18, delete "tot eh" and insert
--to the--

UNITED STATES PATENT AND TRADEMARK OFFICE

CERTIFICATE OF CORRECTION

PATENT NO. : 5,214,902

DATED : June 1, 1993

INVENTOR(S) : Paul T. Jones

It is certified that error appears in the above-indentified patent and that said Letters Patent is hereby corrected as shown below:

Column 11, line 8, delete "supposed" and insert --opposed--

Signed and Sealed this

Eighth Day of February, 1994

Bruce Lehman

*Attest:*

BRUCE LEHMAN

*Attesting Officer*

*Commissioner of Patents and Trademarks*